US008789974B2

(12) United States Patent
Watanabe

(10) Patent No.: US 8,789,974 B2
(45) Date of Patent: Jul. 29, 2014

(54) LIGHTING DEVICE

(75) Inventor: Masashi Watanabe, Fujiyoshida (JP)

(73) Assignees: Citizen Electronics Co., Ltd., Yamanashi-Ken (JP); Citizen Holdings Co., Ltd., Tokyo (JP)

( * ) Notice: Subject to any disclaimer, the term of this patent is extended or adjusted under 35 U.S.C. 154(b) by 162 days.

(21) Appl. No.: 13/332,100

(22) Filed: Dec. 20, 2011

(65) Prior Publication Data

US 2012/0162989 A1 Jun. 28, 2012

(30) Foreign Application Priority Data

Dec. 23, 2010 (JP) ..... P2010-286789

(51) Int. Cl.
*F21V 29/02* (2006.01)
*F21V 29/00* (2006.01)

(52) U.S. Cl.
USPC ..... 362/294; 361/273

(58) Field of Classification Search
CPC ..... F21Y 2101/02; F21Y 2111/007; F21Y 2111/004; F21V 29/004; F21V 29/2293; F21V 29/2262; F21V 29/2206; F21V 15/011; F21V 29/22; F21V 29/262; F21V 29/2212; F21V 29/00; F21V 7/20
USPC ..... 362/294, 373; 257/706–707, 712–722; 313/46
See application file for complete search history.

(56) References Cited

U.S. PATENT DOCUMENTS

2005/0024868 A1 2/2005 Nagai et al.
2005/0047170 A1* 3/2005 Hilburger et al. ..... 362/547
2005/0207152 A1* 9/2005 Maxik ..... 362/231
2005/0253251 A1* 11/2005 An et al. ..... 257/706
2007/0291482 A1* 12/2007 Baroky et al. ..... 362/227
2009/0195186 A1* 8/2009 Guest et al. ..... 315/294
2010/0214777 A1 8/2010 Suehiro et al.
2011/0101861 A1* 5/2011 Yoo ..... 315/35

FOREIGN PATENT DOCUMENTS

JP 2003-168305 A 6/2003
JP 2008-21505 A 1/2008
JP 2008-210655 A 9/2008
JP 2010-199203 A 9/2010

OTHER PUBLICATIONS

Japanese Notice of Reason for Rejection for Japanese Patent Application No. JP2010-286789 issued Mar. 11, 2014 along with English translation.

* cited by examiner

*Primary Examiner* — Anh Mai
*Assistant Examiner* — Nathaniel Lee
(74) *Attorney, Agent, or Firm* — Browdy and Neimark, PLLC

(57) ABSTRACT

A lighting device 1 includes a heat sink 2, a substrate 3 attached to a mounting portion 11 of the heat sink 2, a plurality of light sources 4 mounted on the substrate 3, and a cap 6 electrically connected to the substrate 3 while fixed to a rear portion of the heat sink 2 through a casing 5. The heat sink 2 has a three-dimensional shape including a plurality of mounting portions 11*a*, 11*b* and 11*c* facing in directions different from each other and provided at least at a front-end surface 12 of the heat sink 2. At least the front-end surface 12 is exposed to outside, and a plurality of heat-releasing fins 2*a* is provided around the front-end surface 12. The lighting device has a higher heat-releasing property, and can enlarge an illuminated area.

24 Claims, 4 Drawing Sheets

LIGHTING DEVICE

CROSS-REFERENCE TO RELATED APPLICATION

This application is based on and claims the priority benefit of Japanese Patent Application No. 2010-286789, filed on Dec. 23, 2010, the disclosure of which is incorporated herein by reference in its entirety.

BACKGROUND OF THE INVENTION

1. Field of the Invention

The present invention relates to a lighting device including a light source with a light-emitting element. The present invention also relates to a lighting device including a heat sink.

2. Description of the Related Art

A lighting device in which a light-emitting diode element (hereinafter called an LED element) functioning as a light-emitting element is used as a light source has been commercially available in recent years. Compared to a fluorescent lamp, an incandescent bulb and the like, the lighting device using an LED element consumes a smaller amount of power, provides a longer product life for a light source, and can reduce the size of the lighting device. Further, as a result of the progress of semiconductor technology, high-output and high-intensity LED elements have been manufactured at relatively low costs. Accordingly, the aforementioned lighting device is receiving attention as a light source to take the place of conventional bulbs.

Regarding the aforementioned light source with a high-output LED element, the temperature of the LED element itself is increased as the LED element itself emits light. A product life is shortened if the temperature increase of the LED element continues. Accordingly, the temperature of the LED element should be controlled, for example, by releasing heat from the LED element by connecting an aluminum plate having high heat conductivity or a metallic member such as a heat sink. In addition, an aluminum substrate or a ceramic substrate may be used as a substrate on which the LED element is to be disposed, so that heat from the LED element is transferred rapidly to the substrate, and is further released to a heat sink such as a metal plate thermally connected to the substrate.

As an example, Japanese Patent Application Laid-Open No. 2008-21505 discloses a lighting device in the form of a bulb including an LED element mounted on a flexible substrate, a substantially hemispherical cover for covering the LED element, a plurality of radially-arranged heat-releasing fins that are aluminum die-castings provided for releasing heat from the LED element, and a heat sink composed of a support body for supporting the plurality of heat-releasing fins.

In this lighting device, the support body to which the LED element is attached through the flexible substrate and the plurality of heat-releasing fins release heat efficiently through the air. Further, in this lighting device, a space is formed between the LED element and the cover (being a lens), and this space communicates with a gap between two adjacent heat-releasing fins, thereby enhancing a heat-releasing property.

However, in the aforementioned conventional technique, the following problems remain unsolved. Specifically, in the lighting device disclosed in Japanese Patent Application Laid-Open No. 2008-21505, the entire heat sink including the heat-releasing fins is provided at a position closer to a cap than a position where the LED is mounted. Accordingly, if the lighting device is attached, for example, on a wall surface so as to serve as a downlight and the like, the heat-releasing fins at a position close to the cap are covered with a reflector and the like in the form of a cup, leading to a problem in that heat cannot be released effectively. Further, while the gap between two heat-releasing fins and the space between the LED element and the cover are made to communicate with each other for heat releasing, narrowness of a communicating part makes air convection insufficient. Accordingly, most of heat inevitably remains in the space between the LED element and the cover, leading to a trouble in achieving satisfactory a heat-releasing property.

SUMMARY OF THE INVENTION

As noted above, in order to solve the aforementioned problems, the present invention is provided. A lighting device in accordance with an embodiment of the present invention includes a heat sink that includes a bulging shape with a front-end surface, an opening disposed at an opposite side of the front-end surface, at least one mounting portion provided at the front-end surface of the bulging shape, at least one substrate disposed at the at least one mounting portion of the heat sink, at least one light source provided at the at least one substrate, and a cap that includes at least one electrical contact electrically connected to the at least one light source and disposed at the opposite side opposite to the front-end surface of the bulging shape of the heat sink.

Also, the at least one mounting portion may be disposed at a peripheral surface of the front-end surface of the heat sink. Further, the at least one mounting portion may extend from the front-end surface to the peripheral surface of the heat sink.

The cap may be directly connected to the opening of the heat sink or may be connected to the heat sink through a casing that is disposed between the heat sink and the cap.

The heat sink includes at least one heat-releasing portion. The heat-releasing portion may include a plurality of heat-releasing fins or may include an alumite-treated surface or a surface of resin layer with heat-releasing property higher than that of the at least one mounting portion of the heat sink. Also, the at least one heat-releasing portion may be provided at position closer to the at least one light source than the cap or adjacent to the front-end surface, and therefore, the at least one heat-releasing portion can be separately placed from the cap that is placed at an opposite side, opposite to the front-end surface of the heat sink. In addition, a casing may be disposed between the heat sink and the cap to have a sufficient distance between the heat-releasing portion of the heat sink and the cap.

DETAILED DESCRIPTION OF THE PREFERRED EMBODIMENTS

Figure 1:
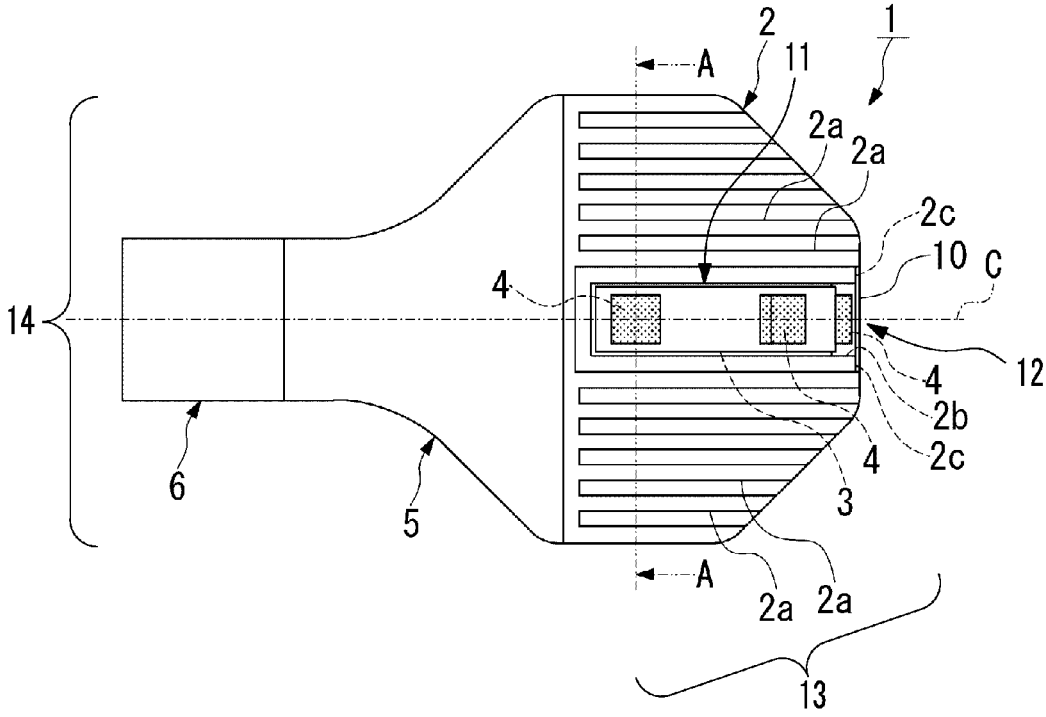
FIG. 1 is a schematic side view showing a first embodiment of a lighting device according to the present invention.

The present invention now will be described more fully hereinafter with reference to the accompanying drawings, in which embodiments of the invention are shown. The present invention may, however, be embodied in many different forms and should not be construed as limited to the specific embodiments set forth herein. Rather, these embodiments are provided to convey the scope of the invention to those skilled in the art. In the drawings, the size and relative sizes of layers and regions may be exaggerated for clarity.

Preferred embodiments of the present invention are described in detail below with reference to the accompanying drawings.

A lighting device 1 includes a heat sink 2 that includes a bulging shape with a front-end surface 12, an opening 2*d* disposed at an opposite side 14 of the front-end surface 12, and at least one mounting portion 11 provided at the front-end surface 12 of the bulging shape, at least one substrate 3 disposed at the at least one mounting portion 11 of the heat sink 2, at least one light source 4 provided at the at least one substrate 3; and a cap 6 including at least one electrical contact electrically connected to the at least one light source 4 and disposed at the opposite side 14 opposite to the front-end surface 12 of the bulging shape of the heat sink 2.

More specifically, a first embodiment of a lighting device according to the present invention is shown in FIGS. 1 to 5.

Figure 2:
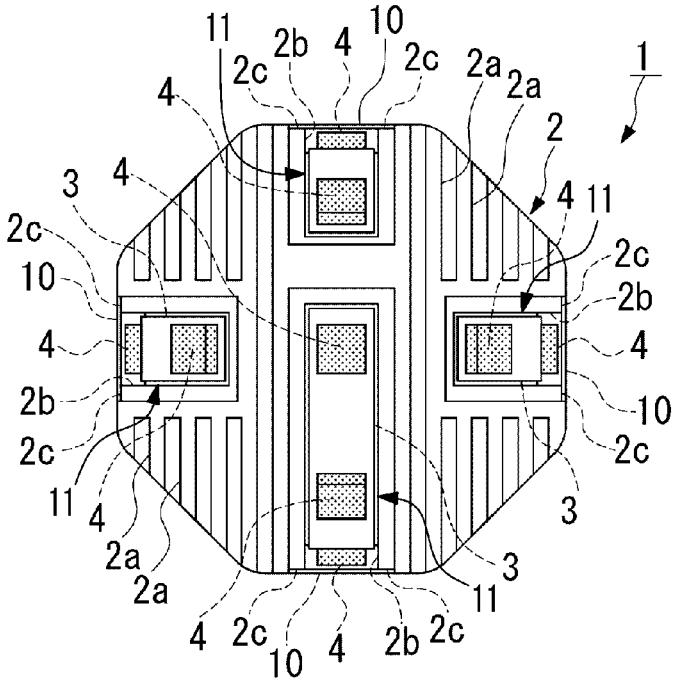
FIG. 2 is a front view showing the lighting device of the first embodiment.
Figure 3:
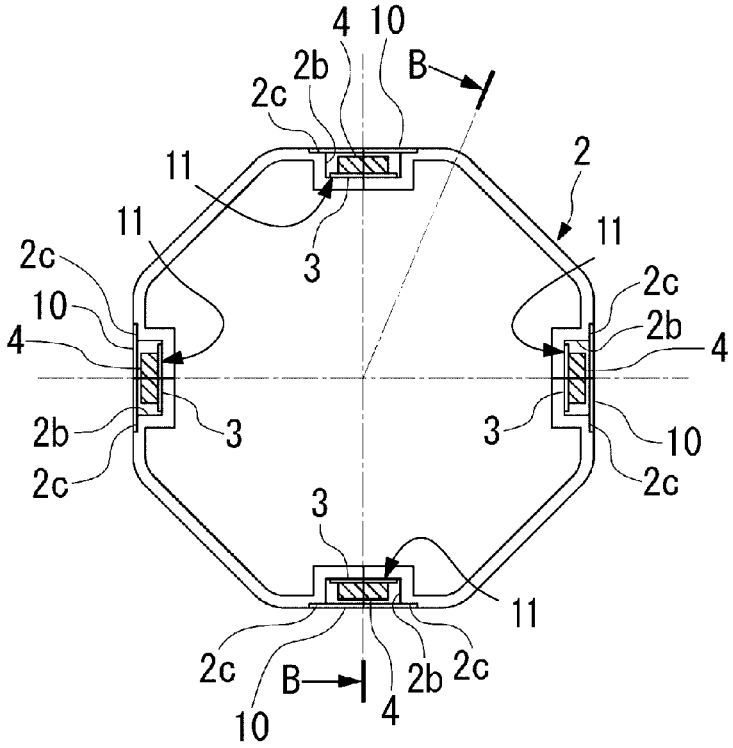
FIG. 3 is a sectional view (excluding a built-in drive circuit portion, heat-releasing fins and others) taken along line A-A of FIG. 1.
Figure 5:
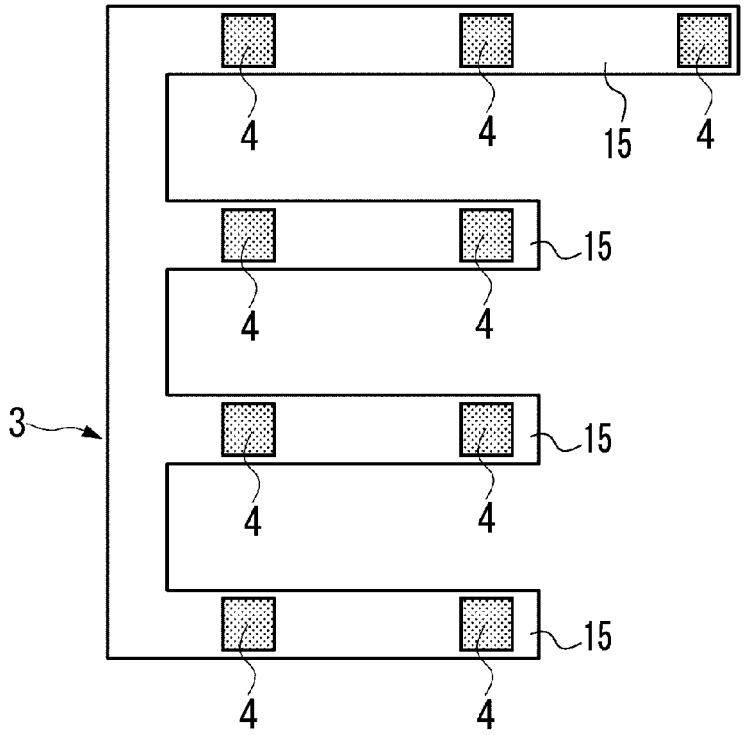
FIG. 5 is a schematic expanded view showing a substrate on which light sources are mounted in the first embodiment.

As shown in FIGS. 1 to 3, the lighting device 1 includes a heat sink 2 having a bulging shape, examples of that include a multi-faceted shape, a shape similar to a hemisphere, and a shape similar to the external shape of light-emitting portion of a generally employed lamp. The heat sink 2 has a front-end surface 12 provided with at least one mounting portion 11, and at least one substrate 3 is disposed at the mounting portion 11. If the mounting portion 11 includes a plurality of mounting portions 11, a plurality of separate substrates 3 may be provided at the mounting portions 11. One or more flexible substrates 3 may be used to arrange light sources 4 at multiple surfaces or facets along the bulging shape. If a single flexible substrate 3 is used, the flexible substrate 3 is provided with a plurality of branch portions 15, and each of the branch portions 15 is provided with a plurality of light sources 4 as shown in FIG. 5, for example.

The heat sink 2 also has a peripheral surface 13 with multiple facets or a curved surface and formed to surround the front-end surface 12. The peripheral surface 13 of the heat sink 2 is also provided with at least one mounting portion 11. A single mounting portion 11 can be configured to extend along a plurality of surfaces, and accordingly, the at least one mounting portion 11 extends from the front-end surface 12 toward the peripheral surface 13 of the heat sink 2.

The lighting device 1 includes the substrate 3 disposed at the mounting portion 11 of the heat sink 2, a plurality of light sources 4 mounted on the substrate 3, and a cap 6 is fixed at a rear portion or an opposite side opposite to the front-end surface 12 of the heat sink 2 through a connection casing 5 between the heat sink 2 and the cap 6. The light source 4 has at least one LED element, and the LED element is thermally connected to the heat sink 2 (to be described later).

The plurality of mounting portions 11 are provided on multiple facets in the heat sink 2, so that the mounting portions 11 face in directions different from each other. Further, at least the front-end surface 12 is exposed to outside, and the front-end surface 12 is provided with a heat-releasing portion that is, for example, a plurality of heat-releasing fins 2*a* having a heat-releasing property higher than that of the mounting portions 11 and provided around the mounting portions 11. In the present embodiment, the mounting portion 11 and the plurality of heat-releasing fins 2*a* are provided to extend to a position adjacent to an opposite side 14 opposite to the front-end surface 12 of the heat sink 2.

Figure 4:
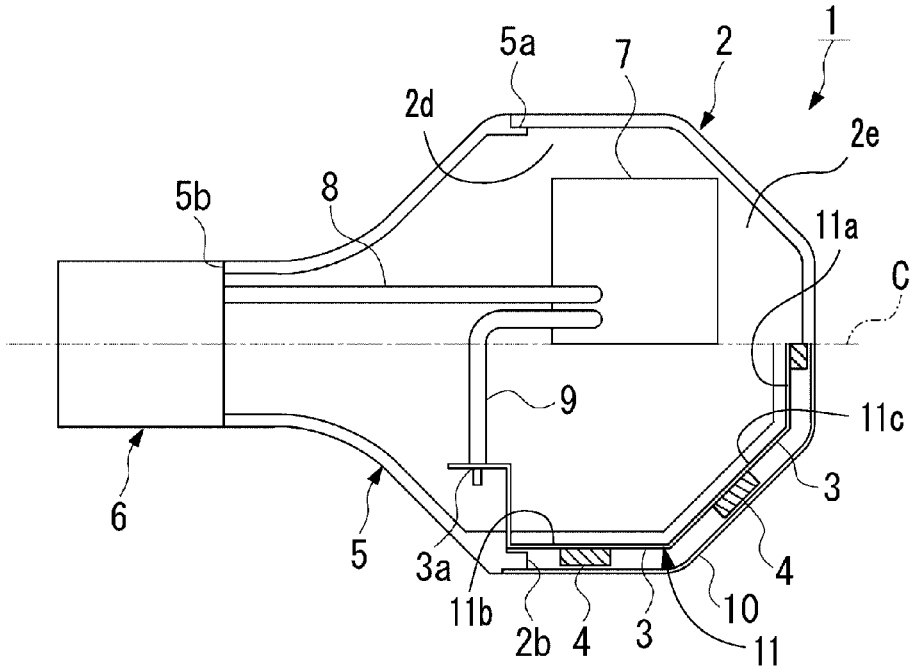
FIG. 4 is a sectional view (excluding the interior of a cap) taken along line B-B of FIG. 3.

As shown in FIG. 4, the heat sink 2 of the present embodiment is in a shape of polyhedron including an opening 2*d* and a hollow space through the opening 2*d* inside the heat sink 2. The heat sink 2 of this embodiment has a shape (elongated square cupola) formed by cutting a rhombicuboctahedron substantially in half. A drive circuit for driving the light source 4 is disposed in the hollow space of the heat sink 2. Further, the heat sink 2 is made of a metallic material having high heat conductivity such as aluminum and silver.

The cap 6 disposed at the opposite side opposite to the front-end surface 12 of the heat sink 2 may be directly connected to the opening 2*d* of the heat sink 2 to close the opening 2*d* of the heat sink 2. As a different embodiment, the casing 5 may be provided between the heat sink 2 and the cap 6. The casing 5 has a first end and a second end smaller in diameter than the first end as shown in FIG. 1. The first end is connected to an opening edge defining the opening 2*d* of the heat sink 2, and the second end is connected to one end of the cap 6. More specifically, the casing 5 is configured to support the heat sink 2. As shown in FIG. 4, the casing 5 has a first opening edge 5*a* disposed at the first end of the casing 5 with the first opening edge 5*a* fitted into the opening edge portion of the heat sink 2 at a rear portion or at an opposite side opposite to the front-end surface 12 of the heat sink 2, so that the casing 5 is fixed. The casing 5 has a second opening edge 5*b* disposed at the second end on the opposite side so that the diameter of the casing 5 gradually becomes smaller from the first opening edge 5*a* disposed at the first end of the casing 5 toward the second opening edge 5*b*. One end of the cap 6 is connected to the second opening edge 5*b* of the casing 5 for fixation. While shown briefly in FIGS. 1 and 4, the cap 6 may include a connection structure such as a screw base and a bayonet base, which can be connected to a socket.

As described above, the lighting device 1 as a whole has a shape close to the conventional shape of what is called a naked bulb, namely a bulb shape where a light-emitting portion of a substantially hemispherical shape with a built-in heating wire as a light-emitting source is fixed to a cap. The shape of the heat sink 2 itself corresponds to a head portion (front portion) of the light-emitting portion of the naked bulb.

A drive circuit portion 7 for the light source 4 is provided inside the heat sink 2. At least one electrode pattern of the substrate 3, and at least one electrical contact of the cap are electrically connected, for example, through a first interconnect line 8 and a second interconnect line 9 to the drive circuit portion 7. Thus, the cap 6 is electrically connected to the substrate 3 through the first interconnect line 8 and the second interconnect line 9, and the drive circuit portion 7.

The drive circuit portion 7 is formed to have electronic circuits such as an AC/DC conversion circuit for driving an LED element in the light source 4 by rectifying an AC voltage to a direct current, a rectifying circuit, and a dimmer circuit. The drive circuit portion 7 is connected through the first interconnect line 8 to an electrode (not shown) of the cap 6, and is connected through the second interconnect line 9 to an electrode 3*a* of the substrate 3.

The light source 4 may be a light source for emitting white light. The light source 4 is a light source that includes a single LED element, or a light source that includes a plurality of LED elements.

The substrate 3 is composed of a single flexible printed substrate that extends with a plurality of branch portions 15 branching off, and on which all of the plurality of light sources 4 are mounted.

The mounting portion 11 of the heat sink 2 has a depressed portion 2*b* for housing the substrate 3 and the plurality of light sources 4. The flexible printed substrate 3 is disposed along the mounting portion 11 in the depressed portion 2*b* while the flexible printed substrate 3 is bent or flexibly fit to, and is bonded to the bottom surface of the depressed portion 2*b* with a heat-conducting adhesive, for example.

The light source 4 is electrically connected to at least one electrode pattern (not shown) provided on the substrate 3 with a conductive adhesive material or by wire bonding or bumps.

As shown in FIG. 4, the mounting portion 11 of the present embodiment includes a first mounting portion 11*a*, four second mounting portions 11*b*, and four third mounting portions 11*c*. The first mounting portion 11*a* is formed in the front-end surface 12 of the heat sink 2 and faces in a direction perpendicular to a central axis C of the heat sink 2 of the bulging shape. The four second mounting portions 11*b* are arranged about the central axis C of the heat sink 2 at angular intervals of 90 degrees and are parallel to the central axis C and face radially with respect to the central axis C. The four third mounting portions 11*c* are arranged between the first mounting portion 11 and each of the second mounting portions 11*b* and face radially and diagonally forward at an angle of 45 degrees with respect to the central axis C. The plurality of light sources 4 are mounted on each of the nine mounting portions 11*a*, 11*b* and 11*c* facing in the nine directions different from each other. Accordingly, light rays emitted from these light sources 4 travel in a radial direction to go beyond the front-end surface 12 through which the central axis C of the heat sink 2 passes.

Further, the lighting device 1 of the present embodiment includes a light-transmitting covering member 10 for covering at least the upper part of the light source 4. To be specific, the covering member 10 may be disposed over the substrate 3 and the upper parts of the plurality of light sources 4 in the depressed portion 2*b* and close the depressed portion 2*b*.

The depressed portion 2*b* has shoulder sections 2*c* at its opposite sides. The shoulder sections 2*c* are provided with steps corresponding to the thickness of the covering member 10. Ends of the covering member 10 at the opposite sides of the covering member 10 are bonded to the steps of the shoulder sections 2*c*. This eliminates a difference in height between the outer surface of the covering member 10 and a surface of the heat sink 2, so that the outer surface of the covering member 10 and the surface of the heat sink 2 can be flush with each other.

The covering member 10 may be a thin resin film. Meanwhile, a light-emitting diode element functioning as the light source 4 may be sealed with a light-transmitting resin material. The resin material may be filled in the depressed portion 2*b* and preferably it has a high heat conductivity.

As described above, the lighting device 1 of the present embodiment has a three-dimensional shape where the plurality of mounting portions 11 face in directions different from each other and the light sources 4 are provided at, at least the front-end surface 12 of the heat sink 2. Further, as at least the front-end surface 12 can be exposed to the outside, due to its position that corresponds to a position of a tip of light-emitting portion of generally employed lamp shape, heat can be easily released. Also, as the lighting device 1 of this embodiment has the plurality of heat-releasing fins 2*a* with a heat-releasing property higher than that of the mounting portions 11 and the heat-releasing fins 2*a* are disposed around the mounting portions 11, heat can be transmitted to the heat-releasing fins 2*a* and effectively released outside. Thus, provision of the heat-releasing fins 2*a* around the mounting portions for the light sources 4 at the front-end surface 12 that is exposed to outside and functions as an effective part of air convection makes it possible to achieve a high heat-releasing property.

Further, the light sources 4 may be provided discretely at the plurality of mounting portions 11 facing in various directions. This avoids concentration of heat and prevents the light sources 4 from being heated, making it possible to expand a product life and utilize a higher amount of light flux. Since the light sources 4 are disposed at the plurality of mounting portions 11 facing in various directions, a wider illuminated area can be ensured. Accordingly, its directivity can be adjusted easily by determining directions in which the mounting portions 11 are to face.

Since the heat-releasing portion such as a heat-releasing fin having a high heat-releasing function is disposed near the light source 4 provided at or adjacent to the front-end surface 12, even if the lighting device is used as a downlight and the like and is covered with a reflector or a kind of lamp shade, degradation of a heat-releasing property can be prevented or suppressed. Additionally, a wide illuminated area can be ensured with the suppressed nonuniformity of lighting intensities, making it possible to provide comfortable lighting.

Also, in the present embodiment, the substrate 3 may be composed of a flexible printed substrate that extends with the plurality of branch portions 15 branching off, and on which the plurality of light sources 4 are mounted. This provides compatibility with the plurality of mounting portions 11 formed in the heat sink 2 of various three-dimensional shapes. In particular, since all of the plurality of light sources 4 are mounted on a single flexible printed substrate, it is possible to reduce a parts count while all the light sources 4 can be easily mounted on the mounting portions 11.

Further, the drive circuit portion 7 for the light sources 4 is provided inside the heat sink 2. This built-in drive circuit portion 7 does not involve any external drive circuit portion 7, so that the entire size of the lighting unit can be reduced.

Further, as the light-transmitting covering member 10 is provided to cover only the substrate 3 and the light sources 4 from above, the covering member 10 does not prevent the above mentioned effect of the heat-releasing fins 2*a*. A single covering member 10 may be provided especially at the front-end surface 12 of the heat sink 2, that is to be exposed to the outside when the lighting device 1 is used. Of course, a plurality of covering members 10 may be provided above the light sources 4 disposed at the facets of the bulging shape of the heat sink 2.

In addition, the covering member 10 is disposed so as to close the depressed portion 2*b* housing the substrate 3 and the light sources 4. Thus, the substrate 3 and the light sources 4 do not project from the surface of the heat sink 2, so that they can be protected from a damage more reliably to be caused during contact with outside, for example, for handling thereof. Further, the outer dimensions of the heat sink 2 can be reduced to realize size reduction thereof.

Figure 6:
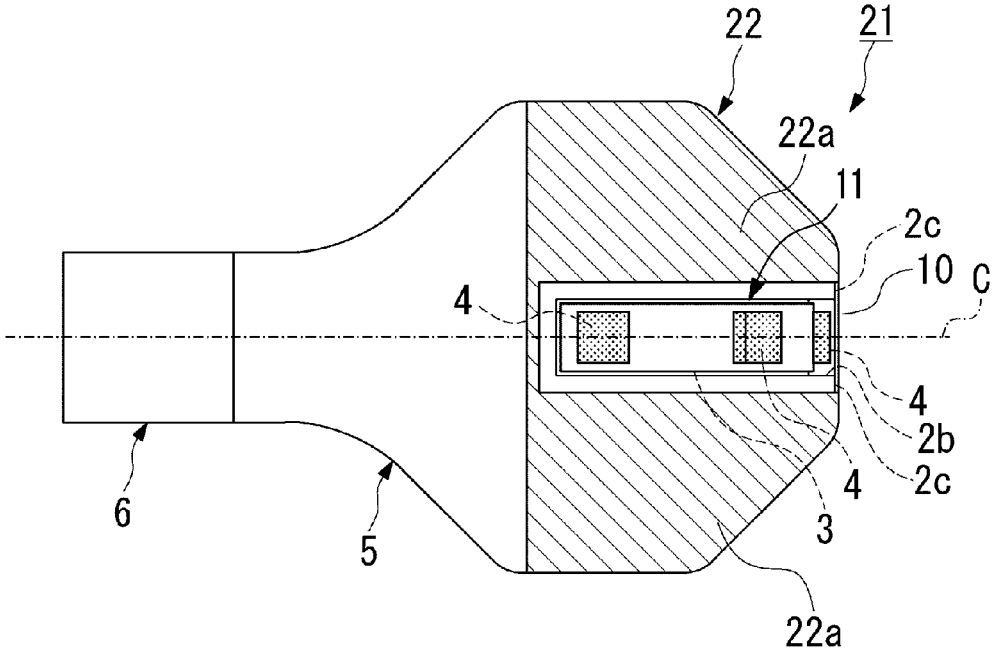
FIG. 6 is a schematic side view showing a second embodiment of the lighting device according to the present invention.
Figure 7:
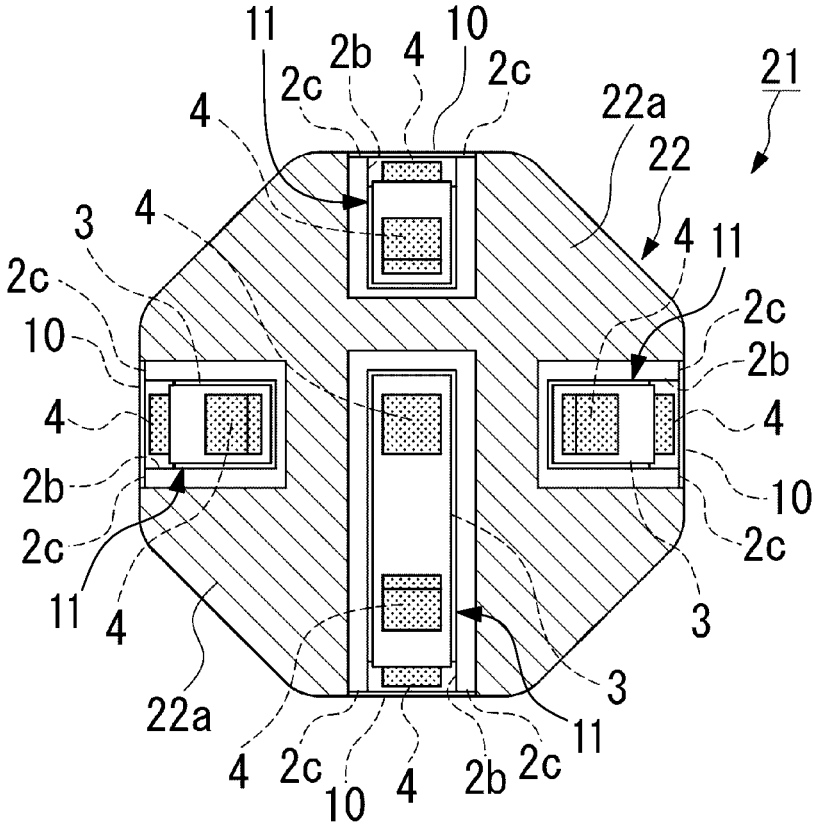
FIG. 7 is a front view showing the lighting device of the second embodiment.

A second embodiment of the lighting device according to the present invention will be described next with reference to FIGS. 6 and 7. In the description of each embodiment given below, components corresponding to those described in the aforementioned embodiment are denoted by the same reference numerals, and will not be described again.

The lighting device 21 according to the present embodiment differs from the first embodiment in the following point. While the plurality of heat-releasing fins 2*a* are provided as a heat-releasing portion around the mounting portion 11 formed in the surface of the heat sink in the first embodiment, a lighting device 21 of the second embodiment as shown in FIGS. 6 and 7 includes a heat sink 22 with an alumite-treated surface 22*a*. The alumite-treated surface 22*a* may have an anodized oxidation coating of aluminum formed on a surface of the heat sink 22 and work as a heat-releasing portion. The alumite-treated surface 22*a* may be disposed around the mounting portion 11 of the heat sink 22.

Specifically, with such alumite-treated surface 22*a* as the heat-releasing portion, the surface of the heat sink 22 can include a smooth surface without projections and depressions of heat-releasing fins and the like. Also, even without such heat-releasing fins disclosed in the first embodiment, heat-releasing effect can be obtained because the alumite-treated surface 22*a* have a thermal emissivity higher than that of aluminum used for forming the heat sink 22. In FIGS. 6 and 7, the area of the alumite-treated surface 22*a* is hatched.

Aluminum used for forming the heat sink 22 has a thermal emissivity of 0.05 (relative rate determined if the thermal emissivity of a black body is 1). Meanwhile, the alumite-treated surface 22*a* has a high thermal emissivity of 0.8, thereby providing excellent heat-releasing effect.

As described above, in the lighting device 21 of the present embodiment, the alumite-treated surface 22*a* having an anodized oxidation coating of aluminum serves as a heat-releasing portion. Thus, a high heat-releasing property can be achieved by the high thermal emissivity of the alumite-treated surface 22*a* formed around the mounting portions 11 for the light sources 4 even without heat-releasing fins disclosed in the first embodiment. Further, due to the absence of projections and depressions of the heat-releasing fins, the heat sink 22 may include a smooth surface of the bulging shape. As a result, light emitted from the light sources 4 will not be affected by the projections and depressions of the heat-releasing fins and the like.

In another example of the second embodiment, a resin-coated surface provided with a resin layer may be used in place of the alumite-treated surface 22*a* as a heat-releasing portion around the mounting portions 11.

For example, a resin layer made of an acrylic resin or a silicone resin is used to form the resin-coated surface. These resin layers have a high thermal emissivity around 0.9, and with these resin layers the lighting device can also achieve an efficient heat-releasing effect.

As described above, in the different example of the second embodiment, a resin-coated surface having a resin layer serves as a heat-releasing portion. Accordingly, since the resin-coated surface around a mounting portion for a light source has a high thermal emissivity, it is possible to achieve a high heat-releasing property.

The present invention is not limited to the embodiments described above, but various changes and modifications can be made to the present invention without departing from the spirit of the present invention.

As an example, in each of the embodiments described above, a heat sink has a shape (elongated square cupola) formed by cutting a rhombicuboctahedron substantially in half. However, the heat sink may be of shapes including three-dimensional shapes such as a polyhedron of a different type, a sphere and an ellipsoidal body, and shapes formed by dividing these three-dimensional shapes in half. As long as the heat sink has a three-dimensional shape with a plurality of mounting portions facing in different directions, a plurality of light sources tilting to any angles can be arranged.

The light source of the present embodiment is assumed to be alight source for emitting white light generally used for purposes of lighting. Meanwhile, a light source for emitting light in different color or a light source for emitting monochromatic light may be used alone or in combination of two or more types of them.

Further, a drive circuit portion is provided inside a heat sink in each of the aforementioned embodiments. Meanwhile, the drive circuit portion may be omitted if an external drive circuit portion is provided.

In addition, a heat sink is shown to be attached through a casing to a cap. Meanwhile, the heat sink may be attached directly to the cap.

What is claimed is:

1. A lighting device comprising:

a heat sink including a bulging shape with a front-end surface, an opening disposed at an opposite side of the front-end surface, and at least one mounting portion provided at the front-end surface of the bulging shape;

at least one substrate disposed at the at least one mounting portion of the heat sink; and at least one light source provided at the at least one substrate;

a cap including at least one electrical contact electrically connected to the at least one light source and disposed at the opposite side opposite to the front-end surface of the bulging shape of the heat sink, the heat sink including at least one heat-releasing portion that is positioned at the front-end surface of the heat sink to release more heat than the at least one mounting portion.

2. The lighting device according to claim 1:

wherein the at least one mounting portion is disposed at a peripheral surface of the front-end surface of the heat sink.

3. The lighting device according to claim 2:

wherein the at least one mounting portion extends from the front-end surface to the peripheral surface of the heat sink.

4. The lighting device according to claim 1:

the at least one light source including at least one light-emitting diode element.

5. The lighting device according to claim 4:

the at least one substrate being a single flexible substrate that includes a plurality of branch portions on that the at least one light-emitting element is mounted.

6. The lighting device according to claim 4, wherein the at least one light-emitting diode element being thermally connected to the heat sink to release heat generated from the at least one light-emitting diode element of the at least one light source.

7. The lighting device according to claim 1:

the cap being directly connected to the opening of the heat sink.

8. The lighting device according to claim 1 further comprising:

a casing including a first end and a second end that is smaller in diameter than the first end; and wherein the first end of the casing is connected to the opening of the heat sink to support the heat sink, and the second end of the casing is connected to the cap.

9. The lighting device according to claim 1:

the at least one heat-releasing portion including a plurality of heat-releasing fins.

10. The lighting device according to claim 9, wherein the mounting portion and the plurality of heat-releasing fins of the at least one heat-releasing portion are extended from the front-end surface to a position adjacent to an opposite side opposite to the front-end surface of the heat sink.

11. The lighting device according to claim 1:

the heat sink including an alumite-treated surface.

12. The lighting device according to claim 1:

the heat sink including a surface of resin layer.

13. The lighting device according to claim 1:

the at least one light source being covered by a light-transmitting member.

14. The lighting device according to claim 1:

the at least one mounting portion of the heat sink including at least one depressed portion in that the at least one light source disposed on the substrate is arranged.

15. The lighting device according to claim 14:

the at least one light-emitting diode element of the at least one light source being sealed in the at least one depressed portion by a light-transmitting resin.

16. The lighting device according to claim 1 further comprising:

the heat sink including a hollow space inside the opening; and a drive circuit disposed in the hollow space of the heat sink to drive the at least one light source.

17. The lighting device according to claim 1, wherein the cap includes a screw base.

18. The lighting device according to claim 1, wherein the cap includes a bayonet base.

19. A lighting device comprising:

a heat sink including a bulging shape with a front-end surface, an opening disposed at an opposite side of the front-end surface, and a plurality of mounting portions provided at the front-end surface;

at least one substrate including at least one electrode pattern and disposed at the plurality of mounting portions of the heat sink;

a plurality of light sources each including at least one light-emitting diode element that is electrically connected to the at least one electrode pattern and disposed on the at least one substrate; and a cap including at least one electrical contact electrically connected to the plurality of light-emitting diode elements of the plurality of light sources through the at least one electrode pattern on the at least one substrate, the cap being disposed at the opposite side opposite to the front-end surface of the heat sink, the heat sink including at least one heat-releasing portion that is positioned among the plurality of mounting portions of the heat sink to release more heat than the plurality of mounting portions.

20. The lighting device according to claim 19:

wherein at least one of the plurality of mounting portions extends from the front-end surface of the heat sink to a peripheral surface of the front-end surface of the heat sink.

21. The lighting device according to claim 20:

wherein the at least one substrate is a single flexible substrate.

22. The lighting device according to claim 21:

wherein the single flexible substrate includes a plurality of branch portions on that all of the plurality of light-emitting diode elements of the light sources are disposed.

23. The lighting device according to claim 19:

the heat sink including at least one heat-releasing portion that releases more heat than the at least one mounting portion.

24. The lighting device according to claim 19:

the plurality of light-emitting diode elements of the plurality of light source being thermally connected to the heat sink to release heat generated from the plurality of light-emitting diode elements.

* * * * *